US005742955A

United States Patent [19]

Parkay et al.

[11] Patent Number: 5,742,955

[45] Date of Patent: Apr. 28, 1998

[54] BATHTUB LINER APPARATUS

[76] Inventors: Steve Parkay; Angie Parkay, both of HC 73 833 Buchanan Rd., Burns, Oreg. 97720

[21] Appl. No.: 714,592

[22] Filed: Sep. 16, 1996

[51] Int. Cl.[6] ..... A47K 3/02

[52] U.S. Cl. ..... 4/583

[58] Field of Search ..... 4/580–583, DIG. 8

[56] References Cited

U.S. PATENT DOCUMENTS

| | | | |
|---|---|---|---|
| D. 361,831 | 8/1995 | Pokosa . | |
| 2,264,672 | 12/1941 | Levine | 4/580 |
| 2,822,553 | 2/1958 | Florentine | 4/583 |
| 3,045,254 | 7/1962 | Cook et al. | 4/580 |
| 3,133,292 | 5/1964 | Spier | 4/580 |
| 3,892,000 | 7/1975 | Morse . | |
| 4,051,563 | 10/1977 | Clarke, Jr. . | |
| 4,069,523 | 1/1977 | Ridgeway . | |
| 4,316,294 | 2/1982 | Baldwin | 4/584 X |
| 4,630,323 | 12/1986 | Sage et al. . | |
| 5,153,950 | 10/1992 | Sowers . | |

FOREIGN PATENT DOCUMENTS

| | | | |
|---|---|---|---|
| 0092935 | 10/1938 | Sweden | 4/581 |
| 0376981 | 7/1932 | United Kingdom | 4/580 |

*Primary Examiner*—Charles E. Phillips

[57] ABSTRACT

A bathtub liner apparatus includes a flexible floor sheet member which includes a top surface and a bottom surface. The flexible floor sheet member includes a drain channel extending from the top surface to the bottom surface. A quantity of adhesive is applied to the bottom surface of the flexible floor sheet member, and flexible projection members project upward from the top surface of the flexible floor sheet member. The flexible floor sheet member may be comprised of a closed cellular foam material The adhesive may become tacky when wet. The flexible projection members include a main crescent-shaped projection member projecting from the top surface of the flexible floor sheet member at a location distal to the drain channel. The main crescent-shaped projection member includes a projection-drainage channel. In addition, the flexible projection members include a plurality of substantially straight, parallelly arranged, projection members extending transversely across the top surface of the flexible floor sheet member between the main crescent-shaped projection member and the drain channel. The flexible projection members may be comprised of closed cellular foam material. A flexible side sheet member may be connected to the flexible floor sheet member. A flexible rim member may be connected to the flexible side sheet member. The flexible floor sheet member, the flexible side sheet member, and the flexible rim member are formed as a unified, integrated structure, and a quantity of an adhesive is located at the bottom portions of this structure.

14 Claims, 3 Drawing Sheets

FIG 1
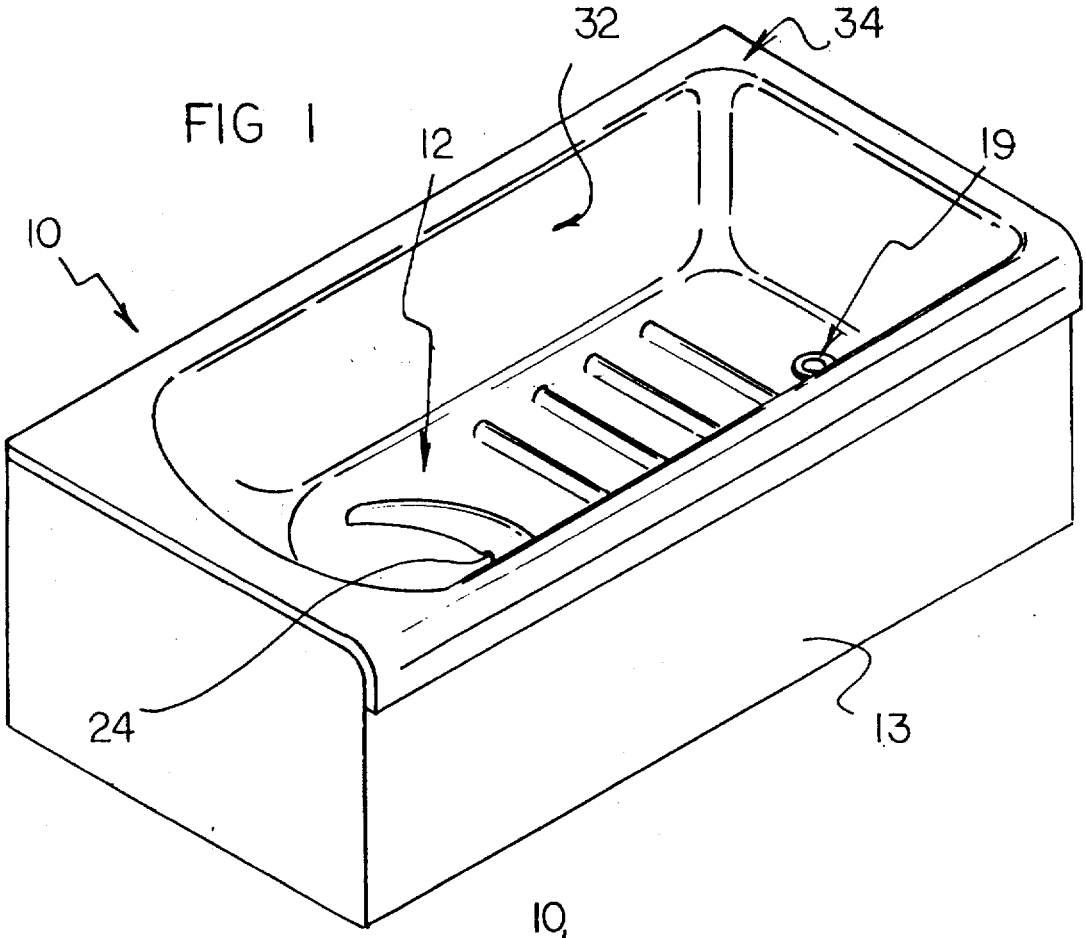
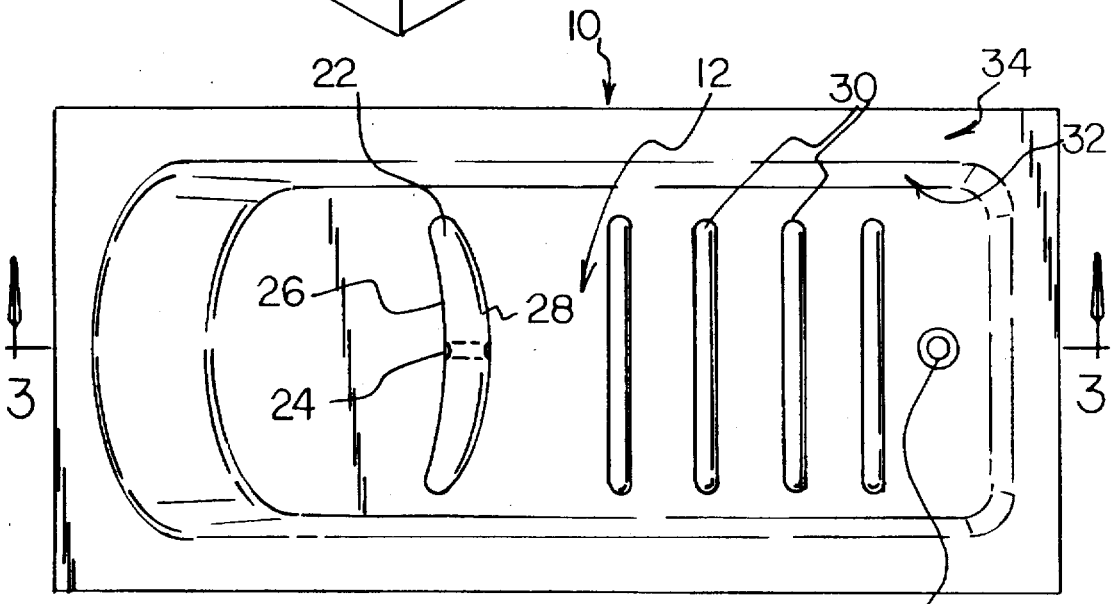
FIG 2

FIG 3
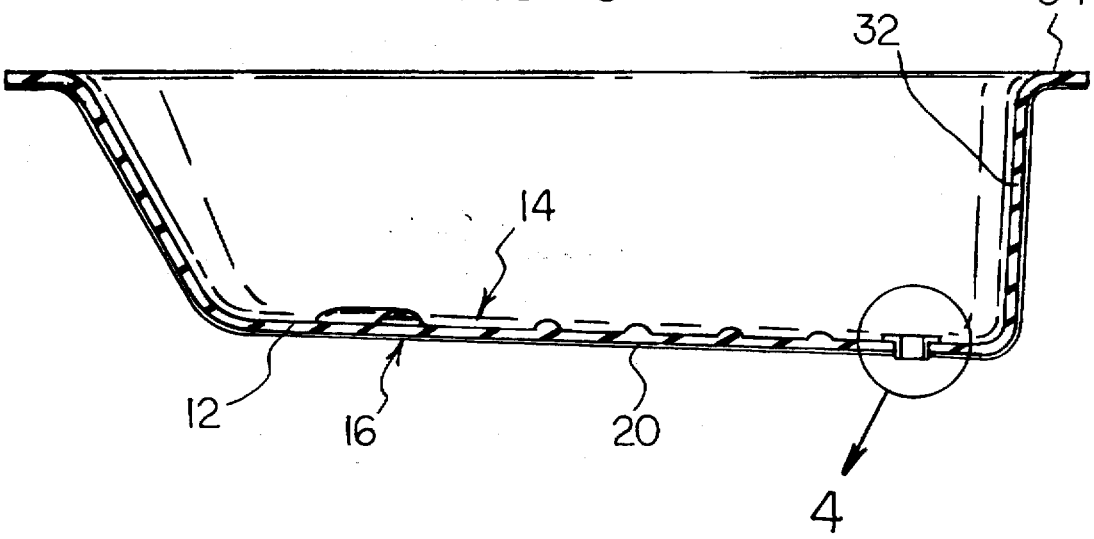
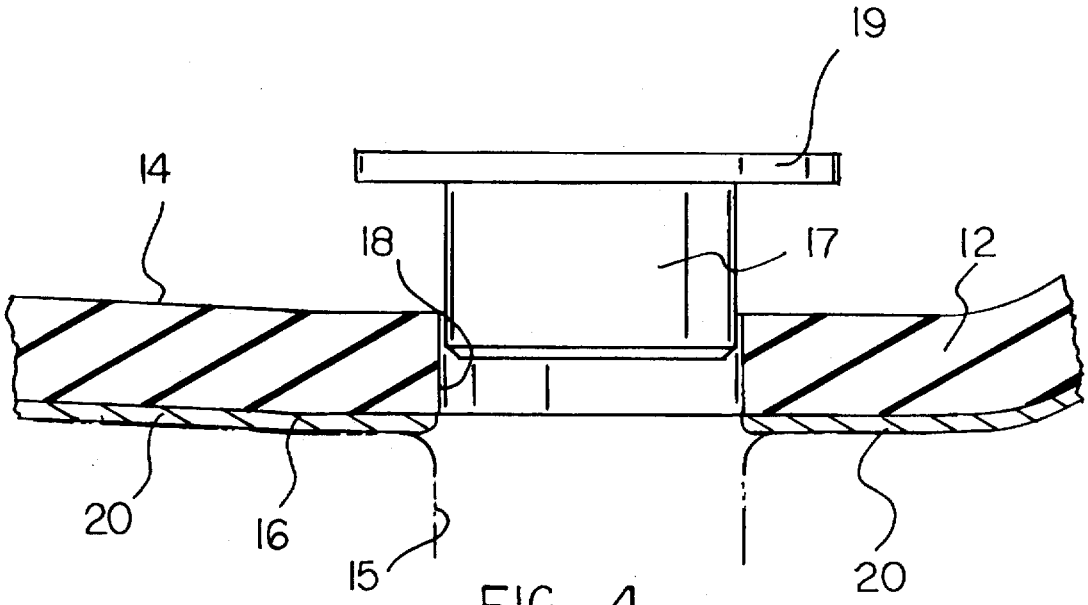
FIG 4

FIG 5
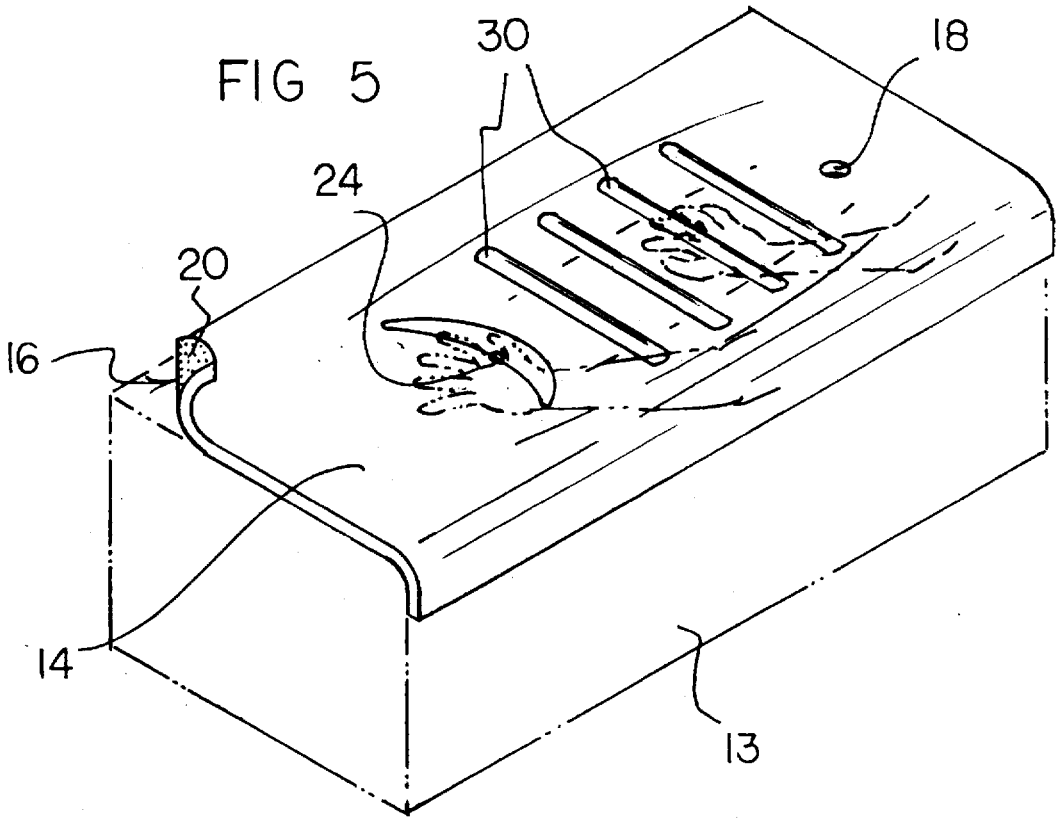
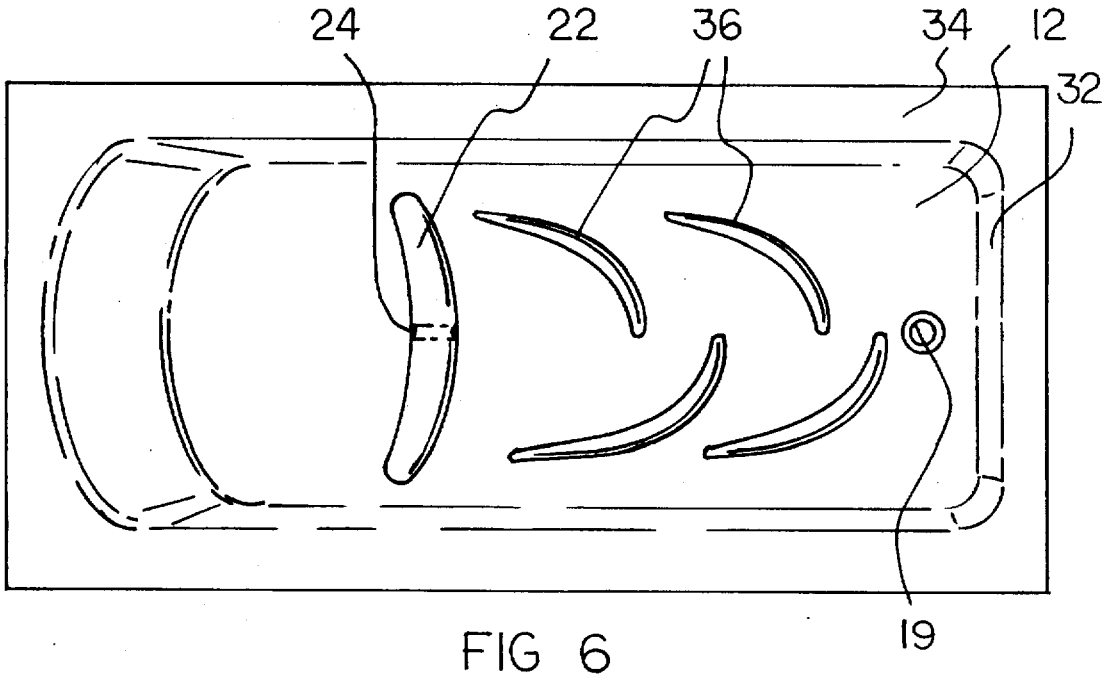
FIG 6

BATHTUB LINER APPARATUS

BACKGROUND OF THE INVENTION

1. Field of the Invention

The present invention relates generally to bathtubs and, more particularly, to devices for increasing friction on the floor of a bathtub.

2. Description of the Prior Art

Generally, the floor of a bathtub is notoriously slippery when wet. A slippery bathtub floor may be a cause of bathtub accidents. That is, a person's feet may slip on the slippery bathtub floor. A number of approaches have been attempted to increase the friction, and thereby reduce the slipperiness, of a bathtub floor. One approach is to imbed abrasive particles in the floor of a bathtub. To do so, the abrasive particles must be imbedded in the bathtub manufacturing facility. However, an enormous number of bathtubs are currently in use which do not have abrasive particles imbedded in the bathtub floor. In this respect, it would be desirable if a device were provided which increased the coefficient of friction of a wet bathtub floor without using abrasive particles imbedded in the bathtub floor.

Another approach to increasing the coefficient of friction of a bathtub floor is to adhere one or more individual appliques to a bathtub floor. One problem associated with individual appliques adhered to the bathtub floor is that the edges of the appliques tend to be peeled up or lifted by transverse forces exerted by a person's body when sitting down or rising up in a bathtub. In this respect, it would be desirable if a device were provided which increased the coefficient of friction of a wet bathtub floor without using individually applied appliques.

In addition, throughout the years, a number of innovations have been developed relating to bathtub liners, and the following U.S. Pat. Nos. are representative of some of those innovations: 3,892,000, 4,051,563, 4,069,523, 4,630,323, 5,153,950, and Des. 361,831. More specifically, U.S. Pat. No. 3,892,000 discloses a cushioned liner for a bathtub that includes a water-filled cushion. Such a water-filled cushion requires efforts to fill, seal, and drain the cushion. Presence of a water-filled cushion also requires considerable complexity in the manufacture of the bathtub liner. In this respect, it would be desirable if a bathtub liner were provided which does not include a water-filled cushion.

U.S. Pat. No. 4,051,563 discloses a soft liner for bathtubs that includes a bottom portion filled with water and side portions inflated with air. The presence of the water-containing and air-containing chambers requires complex manufacturing steps. Moreover, it may be undesirably tedious to fill the water-containing chamber and to inflate the air-inflated chambers. In this respect, it would be desirable if a bathtub liner were provided which does not include water-filled and air-inflated chambers.

U.S. Pat. No. 4,069,523 discloses a bathtub that has cushioned liner made from foam plastic. The soft foam liner is provided as an integral skin for a rigid bathtub. The integral skin is applied to the rigid bathtub at a manufacturing facility. Since vast numbers of bathtubs are already in use which do not have soft foam liners, it would be desirable if a bathtub liner were provided which is made from soft foam and which can be retrofitted to currently in-use bathtubs.

U.S. Pat. No. 4,630,323 discloses a bathtub liner that is fixed to a bathtub by using hook-and-loop fasteners. To use hook-and-loop fasteners, the fasteners on the bathtub must be properly aligned with the fasteners on the liner. There may be times when performing the proper fastener alignments may be difficult. Moreover, after repeated use, the hook-and-loop fasteners may fray and lose their fastening properties. In this respect, it would be desirable if a bathtub liner were provided which does not employ hook-and-loop fasteners for attaching the liner to a bathtub.

U.S. Pat. No. 5,153,950 discloses a flexible bathtub liner which is retrofitted to a bathtub. The bathtub liner includes a drain assembly which permits egress of water from the bathtub. It is noted, however, that this liner does not include soft foam material. Moreover, the bottom portion of the bathtub liner is substantially flat. In this respect, the bottom portion of this bathtub liner does not have a surface contour that conforms to portions of person's body which are seated on the liner. In this respect, it would be desirable if a bathtub liner were provided which has a surface contour which conforms to portions of person's body which are seated on the liner.

U.S. Pat. No. Des. 361,831 discloses a bathtub liner that lines only the walls of a bathtub, not the floor. As stated above, an important feature of a bathtub liner should be providing the bathtub floor with a soft cushion.

Still other features would be desirable in a bathtub liner apparatus. For example, when structures on a bathtub liner floor are provided for conforming to portions of a person's body, such body-conforming structures should not act as water dams and prevent water from adequately draining from the liner when the bathtub is drained. Furthermore, it would be desirable for a bathtub liner to have a drain hole that can be placed in registration with a bathtub drain.

It may be desirable for a bathtub liner to extend upward from a bathtub floor to also cover sidewalls and an upper rim of a bathtub. Not all bathtubs are the same size. Consequently, it would be desirable if a bathtub liner could be provided in one relatively large size that could be trimmed down to be retrofitted to bathtubs having a wide range of sizes.

Thus, while the foregoing body of prior art indicates it to be well known to use bathtub liners, the prior art described above does not teach or suggest a bathtub liner apparatus which has the following combination of desirable features: (1) increases the coefficient of friction of a wet bathtub floor without using abrasive particles imbedded in the bathtub floor; (2) does not employ individually applied appliques; (3) does not include a water-filled cushion; (4) does not include water-filled and air-inflated chambers; (5) is made from soft foam and which can be retrofitted to currently in-use bathtubs; (6) does not employ hook-and-loop fasteners for attaching the liner to a bathtub; (7) has a surface contour which conforms to portions of person's body which are seated on the liner; (8) has body-conforming structures which do not act as water dams which prevent water from adequately draining from the liner when the bathtub is drained; (9) has a drain hole that can be placed in registration with a bathtub drain; (10) extends upward from a bathtub floor to also cover sidewalls and an upper rim of a bathtub; and (11) can be provided in one relatively large size that can be trimmed down to be retrofitted to bathtubs having a wide range of sizes. The foregoing desired characteristics are provided by the unique bathtub liner apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a bathtub liner apparatus which includes a flexible floor sheet member which includes a top surface and a bottom surface. The flexible floor sheet member includes a drain channel extending from the top surface to the bottom surface. A quantity of adhesive is applied to the bottom surface of the flexible floor sheet member, and flexible projection members project upward from the top surface of the flexible floor sheet member. The flexible floor sheet member may be comprised of a closed cellular foam material The adhesive may become tacky when wet.

The flexible projection members include a main crescent-shaped projection member projecting from the top surface of the flexible floor sheet member at a location distal to the drain channel. The main crescent-shaped projection member includes a projection-drainage channel. The main crescent-shaped projection member includes a concave portion facing away from the drain channel and a convex portion facing toward the drain channel.

In addition, the flexible projection members include a plurality of substantially straight projection members extending transversely across the top surface of the flexible floor sheet member. The straight projection members are parallel to each other and are located between the main crescent-shaped projection member and the drain channel. The main crescent-shaped projection member and the straight projection members may be comprised of closed cellular foam material. The flexible floor sheet member and the flexible projection members are formed as a unified, integrated structure.

A flexible side sheet member may be connected to the flexible floor sheet member. A quantity of an adhesive is located on a bottom side of the flexible side sheet member. A flexible rim member may be connected to the flexible side sheet member. A quantity of an adhesive is located on a bottom side of the flexible rim member. The flexible floor sheet member, the flexible side sheet member, and the flexible rim member are formed as a unified, integrated structure.

The flexible projection members can include a plurality of supplementary crescent-shaped members located between the main crescent-shaped projection member and the drain channel.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least two preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved bathtub liner apparatus which has all of the advantages of the prior art and none of the disadvantages.

It is another object of the present invention to provide a new and improved bathtub liner apparatus which may be easily and efficiently manufactured and marketed.

It is a further object of the present invention to provide a new and improved bathtub liner apparatus which is of durable and reliable construction.

An even further object of the present invention is to provide a new and improved bathtub liner apparatus which is susceptible of a low cost of manufacture with regard to both materials and labor, and which accordingly is then susceptible of low prices of sale to the consuming public, thereby making such bathtub liner apparatus available to the buying public.

Still yet a further object of the present invention is to provide a new and improved bathtub liner apparatus which increases the coefficient of friction of a wet bathtub floor without using abrasive particles imbedded in the bathtub floor.

Still another object of the present invention is to provide a new and improved bathtub liner apparatus that does not employ individually applied appliques.

Yet another object of the present invention is to provide a new and improved bathtub liner apparatus which does not include a water-filled cushion.

Even another object of the present invention is to provide a new and improved bathtub liner apparatus that does not include water-filled and air-inflated chambers.

Still a further object of the present invention is to provide a new and improved bathtub liner apparatus which is made from soft foam and which can be retrofitted to currently in-use bathtubs.

Yet another object of the present invention is to provide a new and improved bathtub liner apparatus that does not employ hook-and-loop fasteners for attaching the liner to a bathtub.

Still another object of the present invention is to provide a new and improved bathtub liner apparatus which has a surface contour which conforms to portions of person's body which are seated on the liner.

Yet another object of the present invention is to provide a new and improved bathtub liner apparatus that has body-conforming structures which do not act as water dams which prevent water from adequately draining from the liner when the bathtub is drained.

Still a further object of the present invention is to provide a new and improved bathtub liner apparatus that has a drain hole that can be placed in registration with a bathtub drain.

Yet another object of the present invention is to provide a new and improved bathtub liner apparatus which extends upward from a bathtub floor to also cover sidewalls and an upper rim of a bathtub.

Still a further object of the present invention is to provide a new and improved bathtub liner apparatus that can be provided in one relatively large size that can be trimmed down to be retrofitted to bathtubs having a wide range of sizes.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 1 is a perspective view showing a first embodiment of the bathtub liner apparatus of the invention installed in a bathtub.

FIG. 2 is a top view of the embodiment of the bathtub liner apparatus shown in FIG. 1.

FIG. 3 is a cross-sectional view of the embodiment of the bathtub liner apparatus of FIG. 2 taken along line 3—3 thereof.

FIG. 4 is an enlarged view of a portion of the embodiment of the invention shown in FIG. 3 contained within circled region 4 thereof.

FIG. 5 is a perspective view of the first embodiment of the invention about to be installed in a bathtub.

FIG. 6 is a top view of a second embodiment of the invention installed in a bathtub.

DESCRIPTION OF THE PREFERRED EMBODIMENT

With reference to the drawings, a new and improved bathtub liner apparatus embodying the principles and concepts of the present invention will be described.

Turning to FIGS. 1–5, a first embodiment of the bathtub liner apparatus of the invention is shown and is generally designated by reference numeral 10. In the first embodiment, a bathtub liner apparatus 10 includes a flexible floor sheet member 12 which includes a top surface 14 and a bottom surface 16. The flexible floor sheet member 12 includes a drain channel 18 extending from the top surface 14 to the bottom surface 16. A quantity of adhesive 20 is applied to the bottom surface 16 of the flexible floor sheet member 12, and flexible projection members project upward from the top surface 14 of the flexible floor sheet member 12. The flexible floor sheet member 12 may be comprised of a closed cellular foam material such as disclosed in U.S. Patent No. 4,069,523, incorporated herein by reference. The adhesive 20 may become tacky when wet.

The flexible projection members include a main crescent-shaped projection member 22 projecting from the top surface 14 of the flexible floor sheet member 12 at a location distal to the drain channel 18. The main crescent-shaped projection member 22 includes a projection-drainage channel 24. The projection-drainage channel 24 prevents water from being dammed behind the main crescent-shaped projection member 22 when the bathtub 13 is drained. The main crescent-shaped projection member 22 can be used to secure a person's buttocks when seated on the flexible floor sheet member 12. The main crescent-shaped projection member 22 includes a concave portion 26 facing away from the drain channel 18 and a convex portion 28 facing toward the drain channel 18.

In addition, the flexible projection members include a plurality of substantially straight projection members 30 extending transversely across the top surface 14 of the flexible floor sheet member 12. The straight projection members 30 are parallel to each other and are located between the main crescent-shaped projection member 22 and the drain channel 18. The main crescent-shaped projection member 22 and the straight projection members 30 may be comprised of closed cellular foam material such as used for the flexible floor sheet member 12. The flexible floor sheet member 12 and the flexible projection members are formed as a unified, integrated structure.

A flexible side sheet member 32 may be connected to the flexible floor sheet member 12. A quantity of an adhesive 20 is located on a bottom side of the flexible side sheet member 32. A flexible rim member 34 may be connected to the flexible side sheet member 32. A quantity of an adhesive 20 is located on a bottom side of the flexible rim member 34. The flexible floor sheet member 12, the flexible side sheet member 32, and the flexible rim member 34 are formed as a unified, integrated structure.

To use an embodiment of the bathtub liner apparatus 10 of the invention which has the flexible floor sheet member 12, the flexible side sheet member 32, and the flexible rim member 34 as a unified, integrated bathtub liner structure such as shown in FIGS. 1–5, the unified, integrated bathtub liner structure is placed on the rim of a bathtub 13. The flexible rim member 34 is adhered to the rim of the bathtub 13, and a downward pressure is exerted on the flexible floor sheet member 12 by a person's hands. The downward pressure causes the flexible floor sheet member 12 to approach the floor of the bathtub 13. As the flexible floor sheet member 12 approaches the floor of the bathtub 13, the flexible side sheet member 32 is applied to the side wall of the bathtub 13. When the flexible floor sheet member 12 reaches the floor of the bathtub 13, the flexible rim member 34 is installed on the rim of the bathtub 13, and the flexible side sheet member 32 is installed on the side wall of the bathtub 13. For each of the flexible floor sheet member 12, the flexible side sheet member 32, and the flexible rim member 34, a quantity of adhesive 20 can cause the respective member to adhere to the respective supporting portion of the bathtub 13.

When the flexible floor sheet member 12 is installed on the floor of the bathtub 13, the drain channel 18 is placed in registration with the drain pipe 15 of the bathtub 13. To assure that the drain channel 18 remains in registration with the drain pipe 15, an alignment sleeve 17 can be employed. The alignment sleeve 17 has an upper flange 19 to assure that the alignment sleeve 17 does not irretrievably enter the drain pipe 15. The alignment sleeve 17 fits inside the drain channel 18 and inside the drain pipe 15.

Turning to FIG. 6, a second embodiment of the invention is shown. Reference numerals are shown that correspond to like reference numerals that designate like elements shown in the other figures. In addition,the flexible projection members include a plurality of supplementary crescent-shaped members 36 located between the main crescent-shaped projection member 22 and the drain channel 18.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved bathtub liner apparatus that is low in cost, relatively simple in design and operation, and which may advantageously be used to increase the coefficient of friction of a wet bathtub floor without using abrasive particles imbedded in the bathtub floor. With the invention, a bathtub liner apparatus is provided which does not employ individually applied appliques. With the invention, a bathtub liner apparatus is provided which does not include a water-filled cushion. With the invention, a bathtub liner apparatus is provided which does not include water-filled and air-inflated chambers. With the invention, a bathtub liner apparatus is provided which is made from soft foam and which can be retrofitted to currently in-use bathtubs. With the invention, a bathtub liner apparatus is provided which does not employ hook-and-loop fasteners for attaching the liner to a bathtub. With the invention, a bathtub liner apparatus is provided which has a surface contour which conforms to portions of person's body which are seated on the liner. With the invention, a bathtub liner apparatus is provided which has body-conforming structures which do not act as water dams which prevent water from adequately draining from the liner when the bathtub is drained. With the invention, a bathtub liner apparatus is provided which has a drain hole that can be placed regiregistration with a bathtub drain. With the invention, a bathtub liner apparatus is provided which extends upward from a bathtub floor to also cover sidewalls and an upper rim of a bathtub. With the invention, a bathtub liner apparatus is provided which can be provided in one relatively large size that can be trimmed down to be retrofitted to bathtubs having a wide range of sizes.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

Finally, it will be appreciated that the purpose of the foregoing Abstract provided at the beginning of this specification is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by Letters Patent of the United States is as follows:

1. A bathtub liner apparatus, comprising:

a flexible floor sheet member which includes a top surface and a bottom surface, wherein said flexible floor sheet member includes a drain channel extending from said top surface to said bottom surface, a quantity of adhesive applied to said bottom surface of said flexible floor sheet member, and flexible projection members projecting upward from said top surface of said flexible floor sheet member, wherein said flexible projection members include a main crescent-shaped projection member projecting from said top surface of said flexible floor sheet member at a location distal to said drain channel, and wherein said main crescent-shaped projection member includes a projection-drainage channel.

2. The apparatus of claim 1 wherein said flexible floor sheet member is comprised of a closed cellular foam material.

3. The apparatus of claim 1 wherein said adhesive is tacky when wet.

4. The apparatus of claim 1 wherein said flexible floor sheet member and said flexible projection members are formed as a unified, integrated structure.

5. The apparatus of claim 1 wherein said flexible projection members include a plurality of supplementary crescent-shaped members located between said main crescent-shaped projection member and said drain channel.

6. The apparatus of claim 1 wherein said main crescent-shaped projection member includes a concave portion facing away from said drain channel and a convex portion facing toward said drain channel.

7. The apparatus of claim 1 wherein said flexible projection members include a plurality of substantially straight projection members extending transversely across said top surface of said flexible floor sheet member.

8. The apparatus of claim 7 wherein said straight projection members are parallel to each other and are located between said main crescent-shaped projection member and said drain channel.

9. The apparatus of claim 7 wherein said main crescent-shaped projection member and said straight projection members are comprised of closed cellular foam material.

10. The apparatus of claim 1, further including a flexible side sheet member connected to said flexible floor sheet member.

11. The apparatus of claim 10, further including an adhesive located on a bottom side of said flexible side sheet member.

12. The apparatus of claim 10, further including a flexible rim member connected to said flexible side sheet member.

13. The apparatus of claim 12, further including an adhesive located on a bottom side of said flexible rim member.

14. The apparatus of claim 12 wherein said flexible floor sheet member, said flexible side sheet member, and said flexible rim member are formed as a unified, integrated structure.

* * * * *